US006655343B2

(12) United States Patent
Suzuki et al.

(10) Patent No.: US 6,655,343 B2
(45) Date of Patent: Dec. 2, 2003

(54) ENGINE CONTROL SYSTEM FOR AN OUTBOARD MOTOR

(75) Inventors: Masaru Suzuki, Shizuoka (JP); Syu Akuzawa, Shizuoka (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/141,497

(22) Filed: May 8, 2002

(65) Prior Publication Data

US 2002/0179035 A1 Dec. 5, 2002

Related U.S. Application Data

(60) Provisional application No. 60/322,235, filed on Sep. 13, 2001.

(30) Foreign Application Priority Data

May 8, 2001 (JP) ..... 2001-136919

(51) Int. Cl.[7] ..... F02B 77/00
(52) U.S. Cl. ..... 123/198 D; 73/118.2
(58) Field of Search ..... 123/198 D; 73/118.2; 440/2; 340/438, 463

(56) References Cited

U.S. PATENT DOCUMENTS

| | | | | | |
|---|---|---|---|---|---|
| 4,940,965 | A | * | 7/1990 | Umehara | 340/460 |
| 4,971,583 | A | * | 11/1990 | Umehara | 440/2 |
| 5,016,006 | A | * | 5/1991 | Umehara | 340/984 |
| 5,020,497 | A | * | 6/1991 | Umehara et al. | 477/102 |
| 5,080,619 | A | * | 1/1992 | Uchida et al. | 440/84 |
| 2002/0065169 | A1 | * | 5/2002 | Suzuki et al. | 477/109 |

FOREIGN PATENT DOCUMENTS

| | | |
|---|---|---|
| JP | 62-078451 | 4/1987 |
| JP | 01-306389 | 12/1989 |
| JP | 03-157292 | 7/1991 |
| JP | 06-330801 | 11/1994 |
| JP | 08-094496 | 4/1996 |

* cited by examiner

*Primary Examiner*—Willis R. Wolfe
*Assistant Examiner*—Douglas A Salser
(74) *Attorney, Agent, or Firm*—Knobbe, Martens, Olson & Bear, LLP

(57) ABSTRACT

An electronically controlled engine management system for an outboard motor, which accurately checks the neutral switch for false operation. The accurate neutral switch detection permits an enjoyable boating environment as well as eliminating unnecessary false neutral switch fault alarms.

14 Claims, 7 Drawing Sheets

ENGINE CONTROL SYSTEM FOR AN OUTBOARD MOTOR

PRIORITY INFORMATION

This application is based on and claims priority to Japanese Patent Application No. 2001-136919, filed May 8, 2001 and to the Provisional Application No. 60/322,235, filed Sep. 13, 2001, the entire contents of which is hereby expressly incorporated by reference.

FIELD OF THE INVENTION

The present invention relates generally to an engine control system for an outboard motor, and more particularly to an improved engine control system for determining if the neutral switch is faulty.

SUMMARY OF THE INVENTION

Watercraft engines typically incorporate an engine management system. Within the engine management system is commonly a neutral detection switch to prevent the engine from being started in either forward or reverse gear. Starting the engine in either forward or reverse gear permits a propeller to turn, possibly allowing for an unwanted movement of the watercraft as well as a hazard to anyone in the vicinity of the boat or boat propeller.

Under certain situations the engine management system may acquire data representing a false engine operating environment. In such situations a signal, for example from the neutral switch, may provide false information to the engine management system causing improper engine characteristics to be performed.

One aspect of the present invention is to be able to detect if the neutral switch is operating properly to consistently provide an accurate detection of the neutral position allowing for appropriate watercraft operation. Correct detection of a faulty neutral switch is favorable to the operator and the watercraft passengers as well as possible swimmers around the watercraft.

Another aspect of the present invention is to detect the operation of the neutral switch and accurately monitor and adjust engine parameters accordingly. Various components that can be adjusted in order to ensure proper engine performance depending on the status of the neutral switch may include the fuel injection and ignition.

Constant monitoring of various engine parameters is performed to control engine-running variables to allow the engine to correctly evaluate the status of the neutral switch and operate the engine correctly and efficiently under all conditions. The engine control system monitors the engine speed and determines whether a starting condition is present. During possible false starting conditions the engine management system ensures against false information from the neutral switch to provide the operator with a correct running engine. Such an advanced engine control system allows for correct, high performing engine life.

BRIEF DESCRIPTION OF THE DRAWINGS

The foregoing features, aspects, and advantages of the present invention will now be described with reference to the drawings of a preferred embodiment that is intended to illustrate and not to limit the invention. The drawings comprise seven figures in which.

DETAILED DESCRIPTION OF THE PREFERRED EMBODIMENT

The Overall Construction

Figure 1:
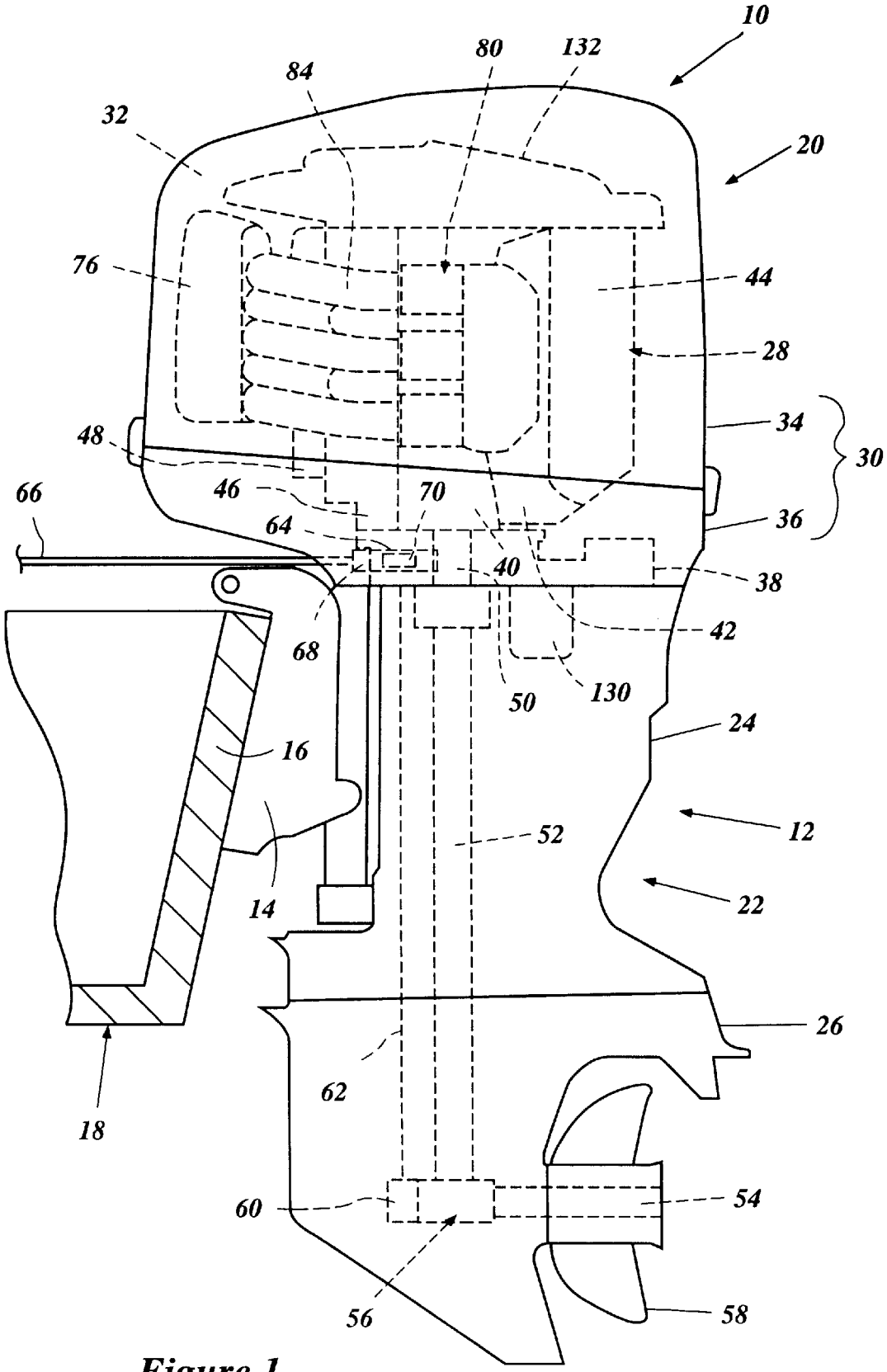
FIG. 1 is a side elevational view of an outboard motor configured in accordance with a preferred embodiment of the present invention, with an associated watercraft partially shown in section.

With reference to FIGS. 1–5, an outboard motor 10 includes a drive unit 12 and a bracket assembly 14. The bracket assembly 14 attaches the drive unit 12 to a transom 16 of an associated watercraft 18 and supports a marine propulsion device such as propeller 58 in a submerged position relative to a surface of a body of water.

As used to this description, the terms "forward," "forwardly," and "front" mean at or to the side where the bracket assembly 14 is located, unless indicated otherwise or otherwise readily apparent from the context use. The terms "rear," "reverse," "backwardly," and "rearwardly" mean at or to the opposite side of the front side.

The illustrated drive unit 12 includes a power head 20 and the housing unit 22. Unit 22 includes a drive shaft housing 24 and the lower unit 26. The power head 20 is disposed atop the housing unit 22 and includes an internal combustion engine 28 within a protective cowling assembly 30, which advantageously is made of plastic. The protective cowling assembly 30 typically defines a generally closed cavity 32 in which the engine 28 is disposed. The engine 28 is thereby is generally protected by the cowling assembly 30 from environmental elements.

The protective cowling assembly 30 includes a top cowling member 34 and a bottom cowling member 36. The top cowling member 34 is advantageously detachably affixed to the bottom cowling member 36 by a suitable coupling mechanism to facilitate access to the engine and other related components.

The top cowling member 34 includes a rear intake opening (not shown) defined from an upper end portion. This rear intake member with one or more air ducts can, for example, be formed with, or affixed to, the top cowling member 34. The rear intake member, together with the upper rear portion of the top cowling member 34, generally defines a rear air intake space. Ambient air is drawn into the closed cavity 32 near the rear intake opening and the air ducts of the rear intake member. Typically, the top cowling member 34 tapers in girth toward its top surface, which is in the general proximity of the air intake opening. This taper reduces the lateral dimension of the outboard motor, which helps to reduce the air drag on the watercraft 18 during movement.

The bottom cowling member 36 has an opening for which an upper portion of an exhaust guide member 38 extends. The exhaust guide member 38 advantageously is made of aluminum alloy and is affixed to the top of the driveshaft housing 24. The bottom cowling member 36 and the exhaust guide member 38 together generally form a tray. The engine 28 is placed on to this tray and can be connected to the exhaust guide member 38. The exhaust guide member 38 also defines an exhaust discharge passage through which burnt charges (e.g., exhaust gases) from the engine 28 pass.

Figure 2:
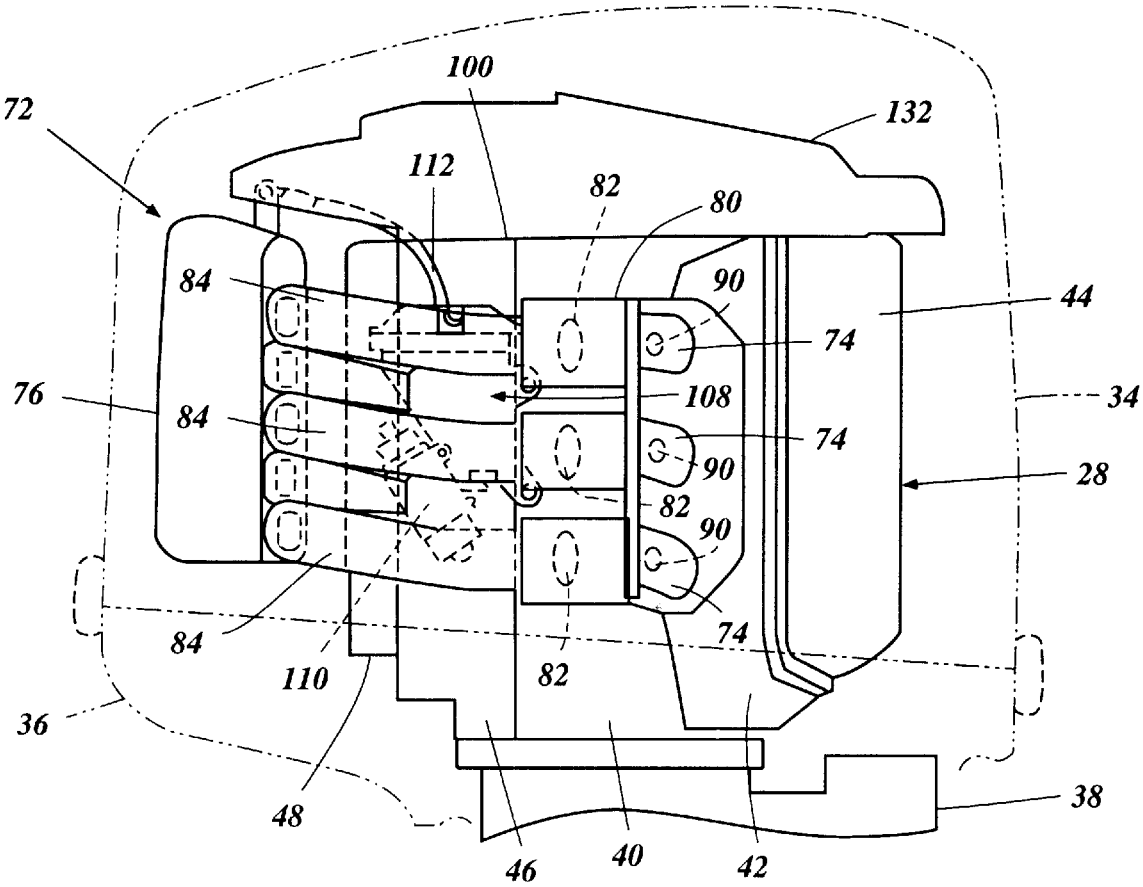
FIG. 2 is a side elevational view of an upper section of an outboard motor configured in accordance with a preferred embodiment of the present invention, with various parts shown in phantom.
Figure 3:
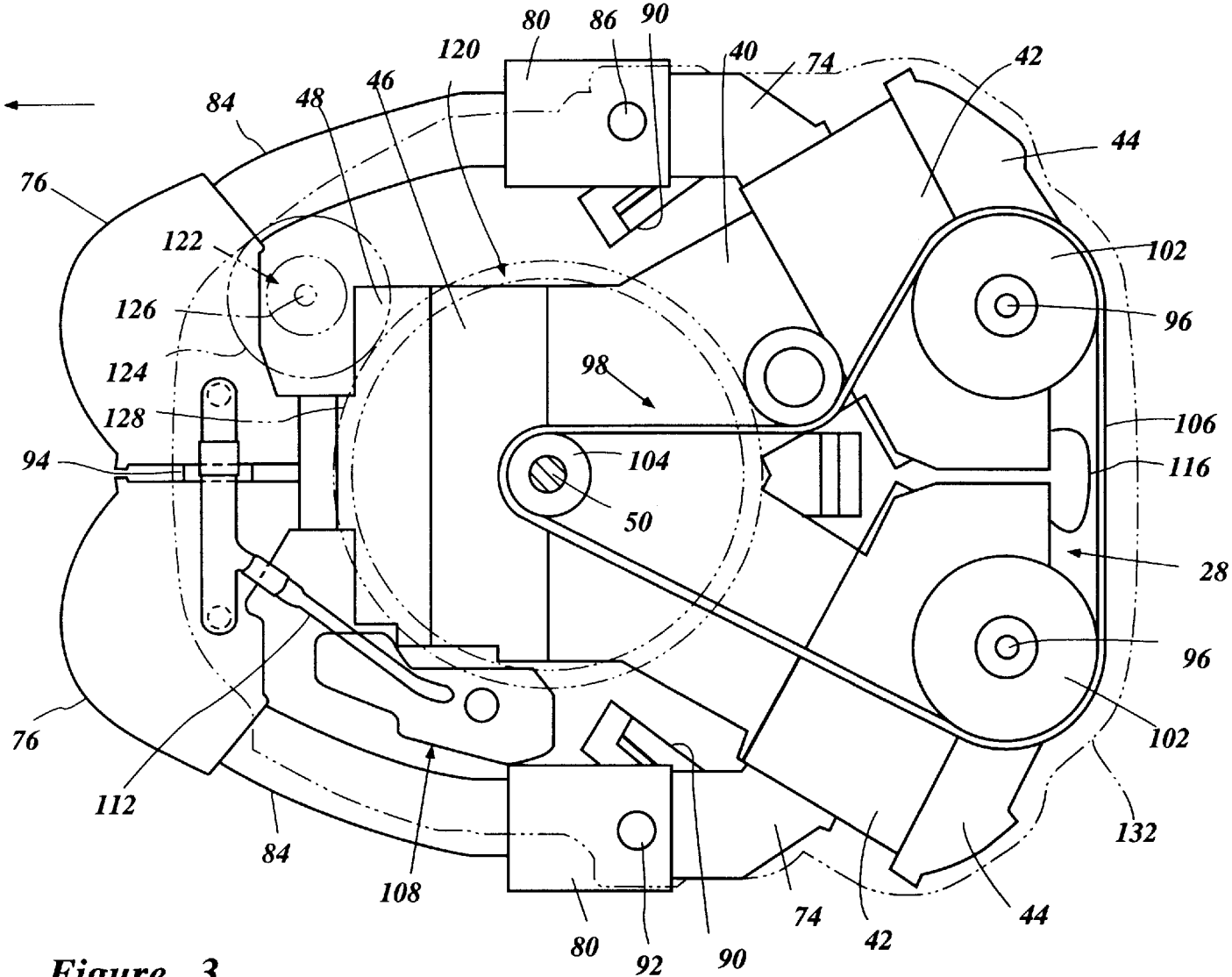
FIG. 3 is a top view of an outboard motor configured in accordance with a preferred embodiment of the present invention, with various parts shown in phantom.

The engine 28 in the illustrated embodiment preferably operates on a four-cycle combustion principle. With reference now to FIGS. 2 and 3, the engine embodiment illustrated is a DOHC six-cylinder engine having a V-shaped cylinder block 40. The cylinder block 40 thus defines two cylinder banks, which extend generally side by side with each other. In the illustrated arrangement, each cylinder bank has three cylinder bores such that the cylinder block 40 has six cylinder bores in total. The cylinder bores of each bank extend generally horizontally and are generally vertically spaced from one another. This type of engine, however, merely exemplifies one type of engine. Engines having other numbers of cylinders, having other cylinder arrangements (in line, opposing, etc.), and operating on other combustion principles (e.g., crankcase compression, two-stroke or rotary) can be used in other embodiments.

As used in this description, the term "horizontally" means that members or components extend generally and parallel to the water surface (i.e., generally normal to the direction of gravity) when the associated watercraft 18 is substantially stationary with respect to the water surface and when the drive unit 12 is not tilted (i.e., as shown in FIG. 1). The term "vertically" in turn means that proportions, members or components extend generally normal to those that extend horizontally.

A movable member, such as a reciprocating piston, moves relative to the cylinder block 40 in a suitable manner. In the illustrated arrangement, a piston (not shown) reciprocates within each cylinder bore. Because the cylinder block 40 is split into the two cylinder banks, each cylinder bank extends outward at an angle to an independent first end in the illustrated arrangement. A pair of cylinder head members 42 are fixed to the respective first ends of the cylinder banks to close those ends of the cylinder bores. The cylinder head members 42 together with the associated pistons and cylinder bores provide six combustion chambers (not shown). Of course, the number of combustion chambers can vary, as indicated above. Each of the cylinder head members 42 is covered with the cylinder head cover member 44.

A crankcase member 46 is coupled with the cylinder block 40 and a crankcase cover member 48 is further coupled with a crankcase member 46. The crankcase member 46 and a crankcase cover member 48 close the other end of the cylinder bores and, together with the cylinder block 40, define the crankcase chamber. Crankshaft 50 extends generally vertically through the crankcase chamber and journaled for rotation about a rotational axis by several bearing blocks. Connecting rods couple the crankshaft 50 with the respective pistons in any suitable manner. Thus, a reciprocal movement of the pistons rotates the crankshaft 50.

With reference again to FIG. 1, the driveshaft housing 24 depends from the power head 20 to support a drive shaft 52, which is coupled with crankshaft 50 and which extends generally vertically through driveshaft housing 24. The driveshaft 52 is journaled for rotation and is driven by the crankshaft 50.

The lower unit 26 depends from the driveshaft housing 24 and supports a propulsion shaft 54 that is driven by the driveshaft 52 through a transmission unit 56. A propulsion device is attached to the propulsion shaft 54. In the illustrated arrangement, the propulsion device is the propeller 58 that is fixed to the transmission unit 56. The propulsion device, however, can take the form of a dual counter-rotating system, a hydrodynamic jet, or any of a number of other suitable propulsion devices.

Preferably, at least three major engine portions 40, 42, 44, 46, and 48 are made of aluminum alloy. In some arrangements, the cylinder head cover members 44 can be unitarily formed with the respective cylinder members 42. Also, the crankcase cover member 48 can be unitarily formed with the crankcase member 46.

The engine 28 also comprises an air intake system 72. The air intake system 72 draws air from within the cavity 32 to the combustion chambers. The air intake system 72 shown comprises six intake passages 74 and a pair of plenum chambers 76. In the illustrated arrangement, each cylinder bank communicates with three intake passages 74 and one plenum chamber 76.

The most downstream portions of the intake passages 74 are defined within the cylinder head member 42 as inner intake passages. The inner intake passages communicate with the combustion chambers through intake ports, which are formed at inner surfaces of the cylinder head members 42. Typically, each of the combustion chambers has one or more intake ports. Intake valves are slidably disposed at each cylinder head member 42 to move between an open position and a closed position. As such, the valves act to open and close the ports to control the flow of air into the combustion chamber. Biasing members, such as springs, are used to urge the intake valves toward their respective closed positions by acting between a mounting boss formed on each cylinder head member 42 and a corresponding retainer that is affixed to each of the valves. When each intake valve is in the open position, the inner intake passage thus associated with the intake port communicates with the associated combustion chamber.

Other portions of the intake passages 74, which are disposed outside of the cylinder head members 42, preferably are defined with intake conduits 78. In the illustrated arrangement, each intake conduit 78 is formed with two pieces. One piece is a throttle body 80, in which a throttle valve assembly 82 is positioned. Throttle valve assemblies 68 are schematically illustrated in FIG. 2. The throttle bodies 80 are connected to the inner intake passages. Another piece is an intake runner 84 disposed upstream of the throttle body 80. The respective intake conduit 78 extends forwardly alongside surfaces of the engine 28 on both the port side and the starboard side from the respective cylinder head members 42 to the front of the crankcase cover member 48. The intake conduits 78 on the same side extend generally and parallel to each other and are vertically spaced apart from one another.

Each throttle valve assembly 82 preferably includes a throttle valve. Preferably, the throttle valves are butterfly valves that have valve shafts journaled for pivotal movement about generally vertical axis. In some arrangements, the valve shafts are linked together and are connected to a control linkage. The control linkage is connected to an operational member, such as a throttle lever, that is provided on the watercraft or otherwise proximate the operator of the watercraft 18. The operator can control the opening degree of the throttle valves in accordance with operator request through the control linkage. That is, the throttle valve assembly 82 can measure or regulate amounts of air that flow through intake passages 74 through the combustion chambers in response to the operation of the operational member by the operator. Normally, the greater the opening degree, the higher the rate of airflow and the higher the engine speed. A throttle valve position sensor 86 measures the throttle valve opening position. The throttle valve position sensor 86 reflects the load requested by the operator and allows an electronic control unit 88 to calculate a signal used by fuel injectors 90 to inject the correct amount of fuel. A manifold pressure sensor 92 measures the pressure in the intake system 72 after the throttle valve assembly 82. this measured pressure reflects the actual load of the engine and is likewise used by the ECU 88 to calculate the signal used by the fuel injectors 90.

The respective plenum chambers 76 are connected with each other through one or more connecting pipes 94 (FIG. 3) to substantially equalize the internal pressures within each chamber 76. The plenum chambers 76 coordinate or smooth air delivered to each intake passage 74 and also act as silencers to reduce intake noise.

The air within the closed cavity 32 is drawn into the plenum chamber 76. The air expands within the plenum chamber 76 to reduce pulsations and then enters the outer intake passages 74. The air passes through the outer intake passage 74 and flows into the inner intake passages. The throttle valve assembly 82 measures the level of airflow before the air enters into the inner intake passages.

The engine 28 further includes an exhaust system that routes burnt charges, i.e., exhaust gases, to a location outside of the outboard motor 10. Each cylinder head member 42 defines a set of inner exhaust passages that communicate with the combustion chambers to one or more exhaust ports which may be defined at the inner surfaces of the respective cylinder head members 42. The exhaust ports can be selectively opened and closed by exhaust valves. The construction of each exhaust valve and the arrangement of the exhaust valves are substantially the same as the intake valve and the arrangement thereof, respectively. Thus, further description of these components is deemed unnecessary.

Exhaust manifolds preferably are defined generally vertically with the cylinder block 40 between the cylinder bores of both the cylinder banks. The exhaust manifolds communicate with the combustion chambers through the inner exhaust passages and the exhaust ports to collect the exhaust gas therefrom. The exhaust manifolds are coupled with the exhaust discharge passage of the exhaust guide member 38. When the exhaust ports are opened, the combustion chambers communicate with the exhaust discharge passage through the exhaust manifolds. A valve cam mechanism preferably is provided for actuating the intake and exhaust valves in each cylinder bank. In the embodiment shown, the valve cam mechanism includes second rotatable members such as a pair of camshafts 96 per cylinder bank. The camshafts 96 typically comprise intake and exhaust camshafts that extend generally vertically and are journaled for rotation between the cylinder head members 42 and the cylinder head cover members 44. The camshafts 96 have cam lobes (not shown) to push valve lifters that are fixed to the respective ends of the intake and exhaust valves in any suitable manner. Cam lobes repeatedly push the valve lifters in a timely manner, which is in proportion to the engine speed. The movement of the lifters generally is timed by rotation of the camshaft 96 to appropriately actuate the intake and exhaust valves.

A camshaft drive mechanism 98 preferably is provided for driving the valve cam mechanism. The camshaft drive mechanism 98 in the illustrated arrangement is formed above a top surface 100 (see FIG. 2) of the engine 28 and includes driven sprockets 80 positioned atop at least one of each pair of camshafts 96, a drive sprocket 104 positioned atop the crankshaft 50 and the flexible transmitter, such as a timing belt or chain 106, for instance, wound around the driven sprockets 102 and the drive sprocket 104. The crankshaft 50 thus drives the respective camshafts 96 through the time belt 106 in the timed relationship.

The illustrated engine 28 further includes indirect, port or intake passage fuel injection. In one arrangement, the engine 28 comprises fuel injection and, in another arrangement, the engine 28 is carburated. The illustrated fuel injection system shown includes six fuel injectors 90 with one fuel injector allotted to each one of the respective combustion chambers. The fuel injectors 90 preferably are mounted on the throttle body 66 of the respective banks.

Figure 4:
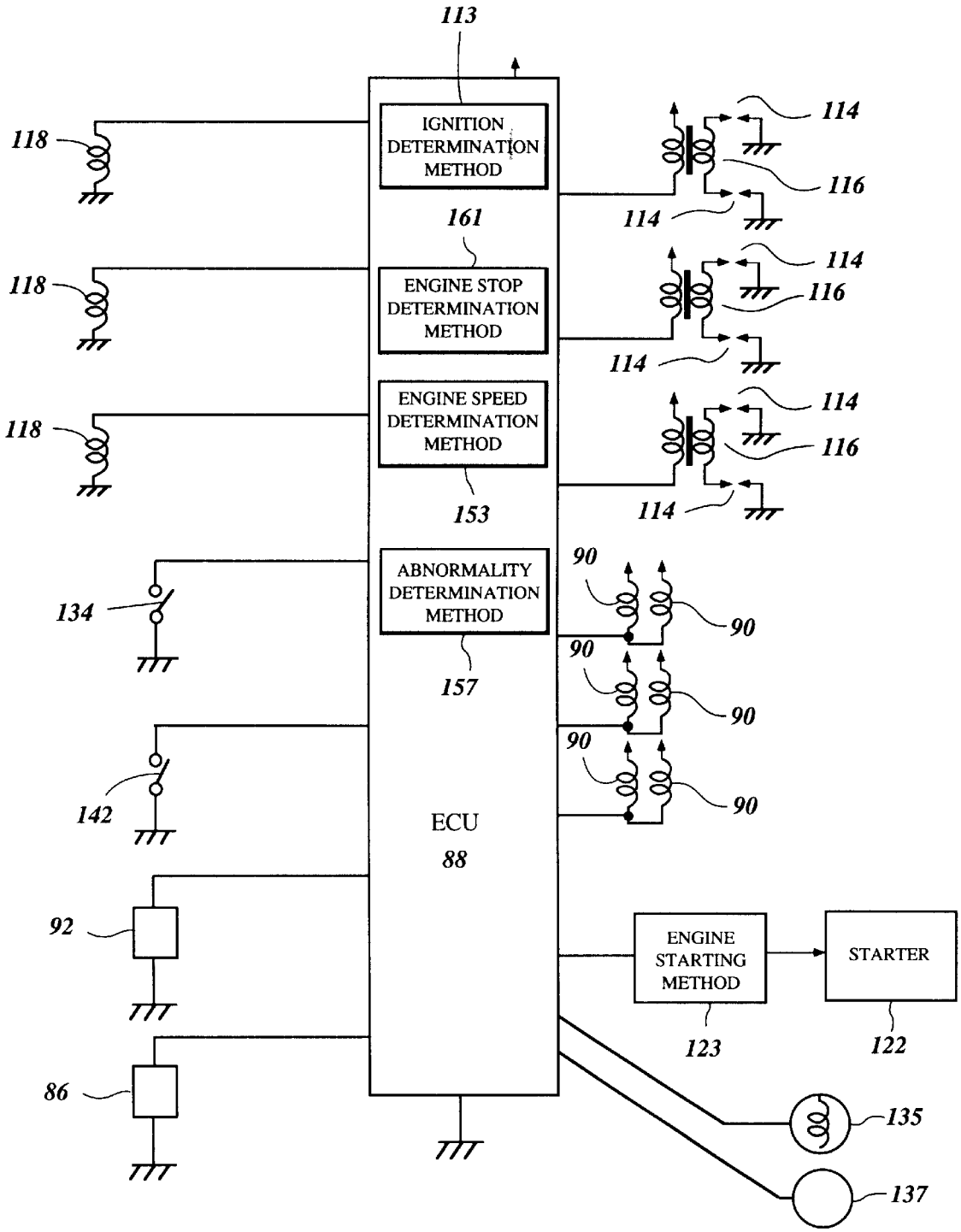
FIG. 4 is a schematic diagram of the electronic control unit and its control parameters.

Each fuel injector 90 has advantageously an injection nozzle directed downstream within the associated intake passage 74. The injection nozzle preferably is disposed downstream of the throttle valve assembly 82. The fuel injectors 90 spray fuel into the intake passages 74 under control of the electronic control unit (ECU) 88 (FIG. 4). The ECU 88 controls the initiation, timing and the duration of the fuel injection cycle of the fuel injector 90 so that the nozzle spray a desired amount of fuel for each combustion cycle.

A vapor separator 108 preferably is in full communication with the tank and the fuel rails, and can be disposed along the conduits in one arrangement. The vapor separator 108 separates vapor from the fuel and can be mounted on the engine 28 at the side service of the port side.

The fuel injection system preferably employs at least two fuel pumps to deliver the fuel to the vapor separator 108 and to send out the fuel therefrom. More specifically, in the illustrated arrangement, a lower pressure pump 110, which is affixed to the vapor separator 108, pressurizes the fuel toward the vapor separator 108 and the high pressure pump (not shown), which is disposed within the vapor separator 108, pressurizes the fuel passing out of the fuel separator 108.

A vapor delivery conduit 112 couples the vapor separator 108 with at least one of the plenum chambers 76. The vapor removed from the fuel supply by the vapor separator 108 thus can be delivered to the plenum chambers 76 for delivery to the combustion chambers with the combustion air. In other applications, the engine 28 can be provided with a ventilation system arranged to send lubricant vapor to the plenum chamber(s). In such applications, the fuel vapor also can be sent to the plenum chambers via the ventilation system.

The engine 28 further includes an ignition system including an ignition determination method 113. Each combustion chamber is provided with a spark plug 114 (see FIG. 4), advantageously disposed between the intake and exhaust valves. Each spark plug 114 has electrodes that are exposed in the associated combustion chamber. The electrodes are spaced apart from each other by a small gap. The spark plugs 114 are connected to the ECU 88 through ignition coils 116. Individual ignition coils 116 can control each spark plug 114 or each ignition coil 116 can control two spark plugs, firing them simultaneously. One or more ignition triggering sensors 118 are positioned around a flywheel assembly 120 to trigger the ignition coils, which in return trigger the spark plugs 114. The spark plugs 114 generate a spark between the electrodes to ignite an air/fuel charge in the combustion chamber according to desired ignition timing maps or other forms of controls.

During engine starting, a starter 122 initiated by an engine starting method 123 can temporarily engage a starter gear 124 through a starter motor shaft 126 with a ring gear 128 attached to the flywheel assembly 120. The starter 122 drives the engaged starter gear 124 to turn the flywheel assembly allowing the engine 28 to start.

Generally, during an intake stroke, air is drawn into the combustion chambers through the air intake passages 74 and fuel is mixed with the air by the fuel injectors 90. The mixed air/fuel charge is introduced to the combustion chambers. The mixture is then compressed during the compression stroke. Just prior to a power stroke, the respective spark plugs ignite the compressed air/fuel charge in the respective combustion chambers. The air/fuel charge thus rapidly burns during the power stroke to move the pistons. The burnt charge, i.e., exhaust gases, then is discharged from the combustion chambers during an exhaust stroke.

The illustrated engine further comprises a lubrication system to lubricate the moving parts within the engine 28. The lubrication system is a pressure fed system where the correct pressure is important to adequately lubricate the bearings and other rotating surfaces. The lubrication oil is taken from an oil reservoir 130 and delivered under pressure throughout the engine to lubricate the internal moving parts.

The flywheel assembly 120, which is schematically illustrated with phantom line in FIG. 3, preferably is positioned atop the crankshaft 50 and is positioned for rotation with the crankshaft 50. The flywheel assembly 120 advantageously includes a flywheel magneto for AC generator that supplies electric power directly or indirectly via a battery to various electrical components such as the fuel injection system, the ignition system and the ECU 88. An engine cover 132 preferably extends over almost the entire engine 28, including the flywheel assembly 120.

In the embodiment of FIG. 1, the driveshaft housing 24 defines an internal section of the exhaust system that leaves the majority of the exhaust gases to the lower unit 26. The internal section includes an idle discharge portion that extends from a main portion of the internal section to discharge idle exhaust gases directly to the atmosphere through a discharge port that is formed on a rear surface of the driveshaft housing 24.

Lower unit 26 also defines an internal section of the exhaust system that is connected with the internal exhaust section of the driveshaft housing 24. At engine speeds above idle, the exhaust gases are generally discharged to the body of water surrounding the outboard motor 10 through the internal sections and then a discharge section defined within the hub of the propeller 58.

The engine 28 may include other systems, mechanisms, devices, accessories, and components other than those described above such as, for example, a cooling system. The crankshaft 50 through a flexible transmitter, such as timing belt 106 can directly or indirectly drive those systems, mechanisms, devices, accessories, and components.

The Engine Control System

Successful engine operation is desirable and requires accurate response and adjustments of the controlling engine parameters. Successful engine operation is dependent in part by a correctly operating neutral switch 134. The present invention provides an engine control routine to accurately evaluate the condition of the neutral switch 134 while inhibiting an abnormal condition alarm when the engine is abruptly stopped. If the neutral switch 134 is found to be faulty, the control routine initiates a visual alarm 135 and an audible alarm 137 to warn the operator.

Figure 5:
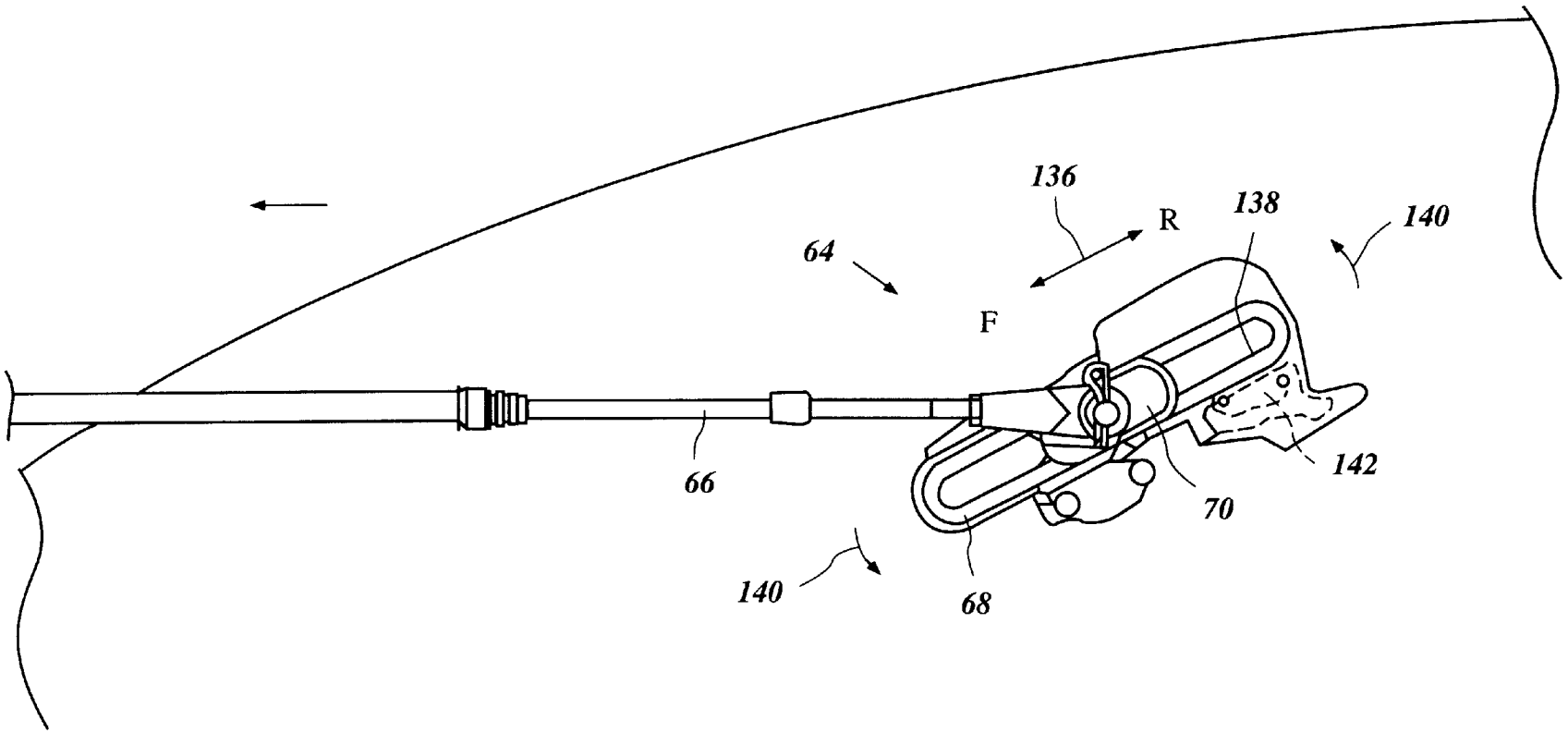
FIG. 5 is a top view of a shifting cable mechanism, with various parts shown in phantom.

As seen in FIG. 5, the construction of the shift cable mechanism 64 is shown. A double sided arrow 136 represents the normal movement of the slider 70 within a guide groove 138 when either a forward gear position represented by F is selected or a reverse gear position represented by R is selected. When the slider 70 is positioned in the middle of the guide groove 138, the neutral switch 134 is closed sending a respective signal to the ECU 88. When, however the slider is in either the forward gear position or the reverse gear position, the neutral switch 134 is open sending a corresponding signal to the ECU 88.

When an engaged forward or reverse gear is reluctant to disengage, for example while engine torque is being applied to the transmission, the force to move the slider 70 can be excessive. During such an excessive force movement of the slider 70, the entire shift bracket 68 moves counter clockwise as shown by arrows 140. The movement of the bracket 68 due to excessive shifting force opens an excessive shifting force switch 142, sending a respective signal to the ECU 88.

Figure 6:
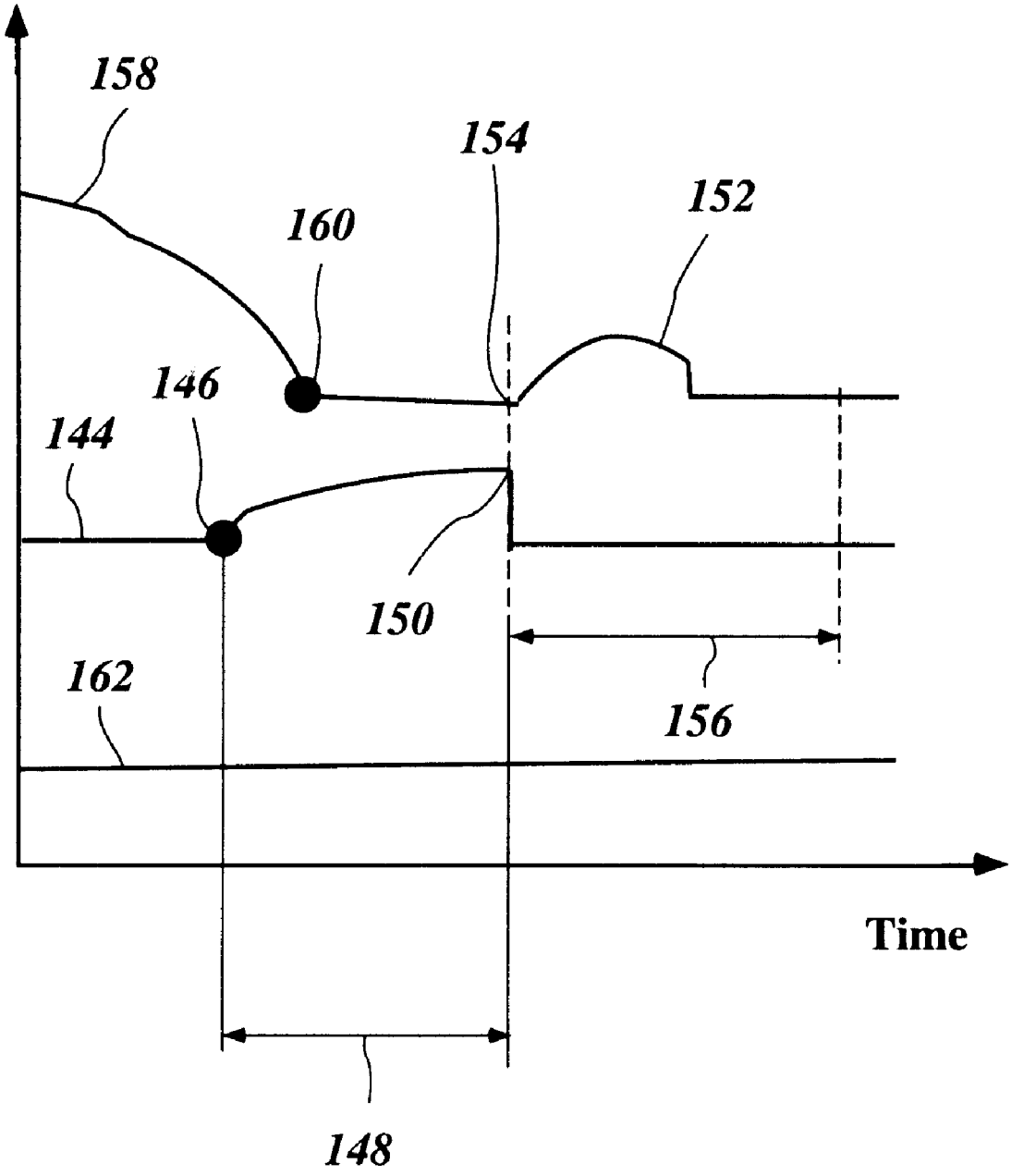
FIG. 6 is a graphical view showing engine parameters with reference to time.

FIG. 6 represents a graph of various engine parameters showing the invention during a period when the ECU automatically detects if the neutral switch 134 is properly operating. Waveform 144 represents an ignition coil current. A point 146 represents the initiation of an ignition coil current timer, which occurs each time a current is applied to the ignition coils 116. If the engine is abruptly stopped, after a predetermined time 148 has passed, the current to the ignition coils is automatically interrupted at a point 150 in order to prevent damage to the ignition coil. Such damage can result if the ignition coil current is allowed to continue after the engine is stopped. In one embodiment of the present invention, the predetermined time 148 can represent 1.28 seconds. The predetermined time 148 only reaches its time limit and interrupts the current to the ignition coils under the condition when the engine is turning at a speed less than 100 RPM. In some instances when the ignition coil current is interrupted, a firing of the corresponding spark plug 114 can occur. If the inadvertent firing of the spark plug 114 occurs when a piston within the engine 28 is just below top dead center during a compression stroke, the engine 28 can begin to turn in the false direction. A signal 152 on the graph represents the detection of the engine turning through an engine speed determination method 153. This turning of the engine after the current to the ignition coils has been interrupted can represent a reverse turning of the engine 28. Any detection from the ignition triggering sensors 118 ranging from a single pulse to a signal representing an engine speed of 500 RPM is translated by the ECU 88 as a starting mode. When the current to the ignition coils 116 is stopped, an abnormal engine rotation timer begins at point 154. A predetermined amount of time 156 is allowed to pass in which the detection of a faulty neutral switch through an abnormality detection method or mode 157 is suspended. In one embodiment of the present invention, the predetermined amount of time can represent 800 milliseconds. The time period 152 compared to the time period 148 is presented in an exaggerated scale to illustrate the engine rotation signal 152. As described below, this suspension of abnormality detection allows for correct determination of status of the neutral switch 134 and inhibits producing a false abnormal signal.

An engine speed signal 158 can be seen decreasing in value with time until it reaches an engine stop point 160, which is determined by an engine stop determination method 161. This engine stop point can be determined by the engine stop determination method 161 when an engine speed signal representing an engine speed less than 100 RPM is present. As can be seen in FIG. 6 the engine can start to turn in either direction when the current to the ignition coils has ceased. A signal 162 from the neutral switch 134 which is unchanged in the open position shows that the ECU 88 detects a start mode when the engine 28 falsely turns. The abnormality determination method of mode 157 does not accurately check the status of the neutral switch 134 during this false start mode period 156.

Figure 7:
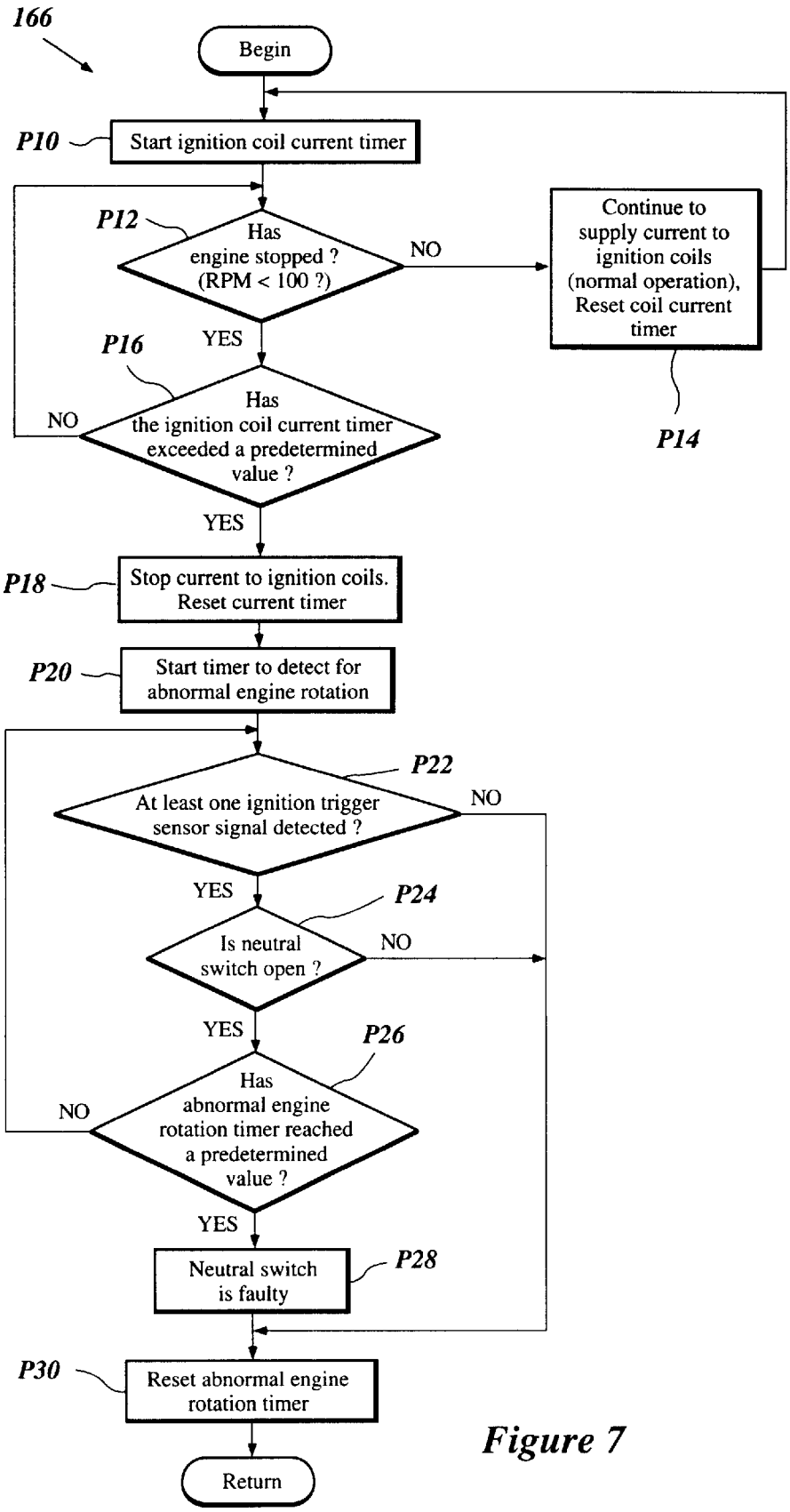
FIG. 7 is a flowchart representing a control routine arranged and configured in accordance with certain features, aspects, and advantages of the present invention.

FIG. 7 shows a control routine 166 implemented by ECU 88 arranged and configured in accordance with certain features, aspects, and advantages of the present invention. The control routine 166 begins and moves to a first operation block P10 in which the ignition coil current timer is started. The control routine 166 then moves to decision block P12.

In decision block P12, it is determined if the engine has stopped; i.e., the RPM is less than 100. If in decision block P12 the engine has not stopped the control routine 150 moves to operation block P14. If, however, in decision block P12 it is determined that the engine has stopped, the control routine moves to decision block P16.

In operation block P14, the coil current timer is reset and normal operation is continued; i.e., the ignition coils receive a normal current.

In decision block P16, it is determined if the ignition coil current timer has exceeded at predetermined value. In decision block P16 if the ignition coil current timer has not exceed a predetermined value, the control routine 166 returns to decision block P12. If, however, in decision block P16 the ignition coil current timer has exceeded a predetermined value, the control routine 166 moves to operation block P18.

In operation block P18, current to the ignition coils is interrupted and the ignition coil current timer is reset. The control routine 166 then moves to operation block P20.

In operation block P20, a timer is started. This timer is set to time the period 156 to suspend detection of a faulty neutral switch during an abnormal engine rotation as described above. The control routine then moves to decision block P22.

In decision block P22, it is determined if at least one ignition trigger sensor has detected a signal. If in decision block P22 it is determined that one ignition triggers sensor signal has not been detected, the control routine 166 moves to operation block P30. If, however, in decision block P22 at least one ignition trigger sensor signal is detected, signaling engine rotation, the control routine moves the decision block P24.

In decision block P24, it is determined if the neutral switch is open. If the neutral switch is not open, the control routine moves to operation block P30. The neutral switch can only be determined to be open by the ECU when the slider 70 is in the forward position, the reverse position, or if there is a fault, e.g. an open circuit within the neutral switch or its wiring. If it is determined that the neutral switch is open, the control routine 166 moves to decision block P26.

In decision block P26, it is determined if an abnormal engine rotation timer has reached a predetermined value. If in decision block P26 an abnormal engine rotation timer has not reached a predetermined value, the control routine 166 returns to decision block P22. If, however, in decision block P26 the abnormal engine rotation timer has reached a predetermined value, the control routine moves to operation block P28.

In operation block P28, the control routine using the abnormality detection method or mode 157 described above, determines that the neutral switch is faulty. During a starting mode, e.g. at least one ignition trigger signal detected after the abnormal engine rotation timer has reached its predetermined value, the neutral switch must be closed in order for the ECU to initiate the starter. If it is determined that the engine 28 is in a starting mode, and the neutral switch is open, the neutral switch must be faulty. The visual alarm 135 and the audible alarm 137 are initiated to warn the operator. The control routine 166 moves to operation block P30.

In operation block P30, the abnormal engine rotation timer is reset. The control routine then returns.

It is to be noted that the control system described above may be in the form of a hard-wired feedback control circuit in some configurations. Alternatively, the control system may be constructed of a dedicated processor and memory for storing a computer program configured to perform the steps described above in the context of the flowchart. Additionally, the control systems may be constructed of a general-purpose computer having a general-purpose processor and memory for storing the computer program for performing the routine. Preferably, however, the control system is incorporated into the ECU 88, in any of the above-mentioned forms.

Although the present invention has been described in terms of a certain preferred embodiments, other embodiments apparent to those of ordinary skill in the art also are within the scope of this invention. Thus, various changes and modifications may be made without departing from the spirit and scope of the invention. For instance, various steps within the routines may be combined, separated, or reordered. In addition, some of the indicators sensed (e.g., engine speed and throttle position) to determine certain operating conditions (e.g., rapid deceleration) can be replaced by other indicators of the same or similar operating conditions. Moreover, not all of the features, aspects and advantages are necessarily required to practice the present invention. Accordingly, the scope of the present invention is intended to be defined only by the claims that follow.

What is claimed is:

1. An outboard engine control system for determining whether the neutral switch is faulty, comprising:

an ignition coil, a first timer initiated when current is applied to said ignition coil, an alarm, a second timer, an electronic control unit responsively coupled to detect rotational speed of said engine below a predetermined value, to detect abnormal operation of said neutral switch, and operatively coupled to said second timer and said alarm, said electronic control unit detecting the position of said neutral switch so that normal commencement of the engine only occurs when the neutral switch is closed, said electronic control unit responds to sudden stopping of said engine and automatically shutting off current to said ignition coil, said second timer being initiated when said current is shut off and inhibits said abnormal switch detection during the period set by said second timer.

2. The outboard control system of claim 1, wherein said first timer period is about 1.28 seconds.

3. The outboard control system of claim 1, wherein said second timer period is about 800 milliseconds.

4. In an outboard engine control system for ascertaining whether the neutral switch is operating abnormally, the method comprising the computer implemented steps of ascertaining whether the engine has abruptly stopped and turning off the current to the ignition coils, starting a timer, detecting whether engine commencement has initiated by virtue of shutting off the current to the ignition coils, and inhibiting producing an abnormal neutral switch alarm until expiration of said timer interval.

5. An outboard engine control system, comprising:

a neutral switch for detecting the neutral position between a forward gear and a reverse gear, a computer implemented method for detecting engine speed, a computer implemented method for starting an outboard engine when a transmission is in a neutral position, a computer implemented method for detecting an engine stop condition based on engine speed and shutting off an ignition coil current, and a computer implemented method for detecting a faulty condition of said neutral switch after a predetermined amount of time is completed.

6. A marine engine control system for determining the condition of a neutral switch, said control system comprising:

an engine speed sensor;

an alarm system;

a programmed electronic control unit responsively coupled to said neutral switch, said engine speed sensor operatively coupled to said fuel injector, and said ignition system, said electronic control unit automatically determining the condition of said neutral switch and initiating said alarm system when said neutral switch is faulty.

7. The marine engine control system of claim 6, wherein the engine speed sensor can comprise one or more ignition triggering sensors.

8. The marine engine control system of claim 6, wherein said alarm provides an acoustical signal.

9. The marine engine control system of claim 6, wherein said alarm provides a visual signal.

10. The marine engine control system of claim 6, wherein said alarm system is inhibited for a predetermined period when the engine is abruptly stopped.

11. The method of determining a faulty neutral switch of a marine engine comprising:

initiating an ignition coil current timer, initiating an abnormal engine rotation timer, sensing the speed of said engine, determining if a neutral switch is open, and automatically determining if neutral switch is faulty if said engine is rotating at a starting speed after said abnormal engine rotation timer is completed and the neutral switch is open.

12. The method of determining a faulty neutral switch of claim 11, wherein said ignition coil current timer represents a time of 1.28 seconds.

13. The method of determining a faulty neutral switch of claim 11, wherein said abnormal engine rotation timer represents a time of 800 milliseconds.

14. The marine engine control system of claim 11, wherein the engine speed sensor comprises one or more ignition triggering sensors.

* * * * *